US008136680B2

(12) United States Patent
Sugarman

(10) Patent No.: US 8,136,680 B2
(45) Date of Patent: Mar. 20, 2012

(54) WHITEBOARD MOUNTING SYSTEM

(75) Inventor: Rob Sugarman, Farmingdale, NY (US)

(73) Assignee: Tequipment, Inc., Huntington Station, NY (US)

( * ) Notice: Subject to any disclaimer, the term of this patent is extended or adjusted under 35 U.S.C. 154(b) by 534 days.

(21) Appl. No.: 12/258,314

(22) Filed: Oct. 24, 2008

(65) Prior Publication Data

US 2009/0159770 A1 Jun. 25, 2009

Related U.S. Application Data

(60) Provisional application No. 60/982,321, filed on Oct. 24, 2007.

(51) Int. Cl.
*A47F 7/00* (2006.01)

(52) U.S. Cl. ..... 211/85.7; 211/94.01; 434/408

(58) Field of Classification Search ..... 211/94.01, 211/94.02, 162, 85.7, 46, 126.13; 434/408; 40/642.01, 642.02, 585, 491; 248/476, 477, 248/494–497, 500, 501

See application file for complete search history.

(56) References Cited

U.S. PATENT DOCUMENTS 2,992,743 A * 7/1961 Wing ..... 108/48
3,080,668 A * 3/1963 Rodolfo ..... 40/476
3,081,972 A * 3/1963 Gray, Jr. ..... 248/469
3,370,822 A * 2/1968 Miller ..... 248/476
4,033,060 A * 7/1977 Lawrence ..... 40/760
4,057,923 A * 11/1977 Chase ..... 40/773
4,239,170 A * 12/1980 Planebo ..... 248/447.1
5,332,108 A * 7/1994 Blass ..... 211/90.02
5,342,014 A * 8/1994 Wilson ..... 248/476
5,794,795 A * 8/1998 Stemmons ..... 211/26
5,873,642 A * 2/1999 Domenig ..... 312/183
6,263,602 B1 * 7/2001 Seiber et al. ..... 40/594
6,533,238 B2 * 3/2003 Barnes et al. ..... 248/680
6,688,568 B1 2/2004 Moufflet
6,854,202 B1 * 2/2005 Ives et al. ..... 40/491
7,100,780 B1 * 9/2006 VanCalbergh et al. .... 211/94.01
7,296,697 B2 * 11/2007 Costa et al. ..... 211/175
7,407,060 B2 * 8/2008 Swartz et al. ..... 211/94.01
2005/0191611 A1 9/2005 Owen et al.
2008/0093319 A1 4/2008 Stover et al.
2009/0101608 A1 4/2009 Sloat

* cited by examiner

*Primary Examiner* — Korie H. Chan
(74) *Attorney, Agent, or Firm* — Hani Z. Sayed; Rutan & Tucker, LLP

(57) ABSTRACT

The mounting system may be used to support a display on a support surface. The mounting system may include a top rail secured to the support surface. The mounting, system may also include a mounting arm hung from the top rail and a support rail attached to the mounting arm that supports the whiteboard. The mounting system may provide permanent or removable attachment to the support surface that may interchangeably accommodate a variety of displays.

6 Claims, 4 Drawing Sheets

WHITEBOARD MOUNTING SYSTEM

CROSS REFERENCE TO RELATED APPLICATION

This application claims priority to U.S. Provisional Patent Application No. 60/982,321, filed Oct. 24, 2007, which is incorporated herein in its entirety.

TECHNICAL FIELD

The field of the invention is for a mounting system. More specifically, the invention encompasses a device to support a display, such as a whiteboard.

BACKGROUND

Teaching professionals utilize many different educational tools to illustrate concepts and assist student understanding and development. Instructors have used chalkboards for decades to illustrate visual characteristics to a students to help them visualize and understand information. A chalkboard utilizes a piece of chalk, usually of a lighter color, against a darker color board. The chalk, however, caused dust when used. Chalkboards were also limited in their color range and the visibility of the chalk to a large audience. Whiteboards or dry-erase boards, were subsequently developed to permit an instructor to write on a white colored board with markers of various colors. The marks were then easily removed by wiping them off the surface of the board. The whiteboards are Generally easier to use and less messy. The use of whiteboards have proliferated into everyday use in offices, meeting rooms, classrooms, and other environments.

However, one common problem with conventional whiteboards, is that there are essentially only two types: (1) permanently mounted, and (2) portable. The permanently affixed whiteboard acts as a replacement to the chalkboard, but is limited to only that functionality. A portable whiteboard generally has a plurality of feet and a support to hold the board on a wheelable base. Therefore, the whiteboard may be replaced and moved to a new location as needed by the user. The portable whiteboard is generally smaller, and is still cumbersome to set up, remove, and store. Interactive whiteboards are generally even more difficult to transport as they are generally heavier and more delicate because of the additional electronics within the board.

BRIEF SUMMARY

The mounting system may be used to permanently or removably attach a display, such as an interactive whiteboard, to a support surface, such as a wall or movable mount. The mounting system may be configured to fit over an existing wall feature, such as a chalk board. The mounting system may utilize a top rail which is secured to the support surface. One or more mounting arms are hung from the top rail. These mounting arms may be attached to at least one support rail. Additionally, the support rail may include a cleat to support a display. The mounting system may utilize hook and loop fasteners to secure the display to another support rail, or the mounting arm to the support surface. The mounting arm may additionally include a leveling foot to adjust alignment of the mounting system.

In an exemplary embodiment, a mounting system to support a display to a support surface, the system comprising: a top rail configured to attach to a support surface; a plurality of mounting arms removably attached to the top rail; and a top support rail removably attached to the plurality of mounting arms and configured to support the display.

In an exemplary embodiment, further comprising: an attachment portion is attached to each of the plurality of mounting arms to hang each of the plurality of mount arms from the top rail.

In an exemplary embodiment, wherein the attachment portion is a clip that hangs from a cleat on the top rail.

In an exemplary embodiment, wherein the plurality of mounting arms include leveling feet which allow to adjustment of the arms relative to the distance between the support surface and the display.

In an exemplary embodiment, further comprising a finger cleat configured to attach to the support surface and secure the leveling foot in position.

In an exemplary embodiment, further comprising: a finger cleat configured to attach to the support wall and designed to secure the mounting arm in place.

In an exemplary embodiment, wherein the plurality of mounting arms are configured to have a contour that fits over an existing wall feature.

In an exemplary embodiment, wherein the plurality of mounting arm-s include a plurality of coupling locations for adjustment of the a height of the top support rail.

In an exemplary embodiment, wherein the top support rail includes a cleat to support the display.

In an exemplary embodiment, further comprising: a bottom support rail attached to the plurality of mounting arms.

In an exemplary embodiment, wherein the bottom support rail is removably attached to the display with a hook and loop fastener.

In an exemplary embodiment, wherein the bottom support rail is removably attached to the display with an adhesive.

In all exemplary embodiment, wherein the display is an interactive whiteboard.

In an exemplary embodiment, a mounting system to allow attachment to a support surface, the system comprising: a top rail configured to be coupled to a support surface; at least one mounting arm attached to the top rail; a top support rail removably attached to at least one mounting arm and configured to support a device; and a bottom support rail removably attached to at least one mounting arm and configured to attach to the device.

In an exemplary embodiment, wherein the top support rail has a cleat thereon to support the device.

In an exemplary embodiment, wherein the bottom rail attaches to the device through a hook and loop fastener means.

In an exemplary embodiment wherein the two or more mounting aims include a leveling foot.

In an exemplary embodiment, wherein the leveling foot is attached to the support surface by a finger cleat.

In an exemplary embodiment, wherein the device is an interactive whiteboard.

In an exemplary embodiment, a method of securing a mounting system to a support surface and mounting a display, thereon the method comprising the steps of: securing a top rail a support surface; coupling an upper support rail and lower support rail to at least one mounting arm, wherein the upper support rail includes a cleat facing away from the at least one mounting arms; hanging at least one mounting arm from the top rail; and mounting the display by hanging the display from the cleat on the upper support rail and connecting the display to the lower support rail with a hook and loop fastener means.

Disclosed is a whiteboard mounting, system. The mounting system may include a top rail attached to a support surface, such as a wall or a portable mount. The top rail may support two or more mounting arms, which may removably attach to the top rail. One or more support rails may be attached to the mounting aims and to the whiteboard to secure the whiteboard to the support surface. For example, the whiteboard may hang from a top support rail, and be removably attached to a lower support rail through hook and loop fasteners. In an exemplary embodiment, the mounting arms may also include leveling feet to properly position and support the mounting system against the support surface. These leveling feet may be removably attached to the support surface through hook and loop fasteners or with finger cleats.

In an exemplary embodiment, the mounting system may permit semi-permanent or permanent attachment to any surface, including a wall or movable frame. In another exemplary embodiment, the mounting system may permit easy removal of a board for relocating to or storing in various locations. The mounting system may additionally be used to easily accommodate and interchange various sizes, shapes, and kinds of boards, depending on the user's desired requirements.

DETAILED DESCRIPTION

In the following description of preferred embodiments, reference is made to the accompanying drawings which form a part hereof, and in which it is shown by way of illustration specific embodiments in which the invention can be practiced. It is to be understood that other embodiments can be used and structural changes can be made without departing from the scope of the embodiments of this invention.

Although embodiments of the invention may be described and illustrated herein in terms of whiteboards, and particularly smart boards, it should be understood that embodiments of this invention are not so limited, but are additionally applicable to any support system. For example, features of the present invention may be used with chalk boards or bulletin boards. Furthermore, although embodiments of the invention may be described and illustrated herein in terms of educational tools, including whiteboards, it should be understood that embodiments of the invention are also applicable to other industries, such as electronic controls and displays, including audio/video equipment mounting systems.

Figure 1:
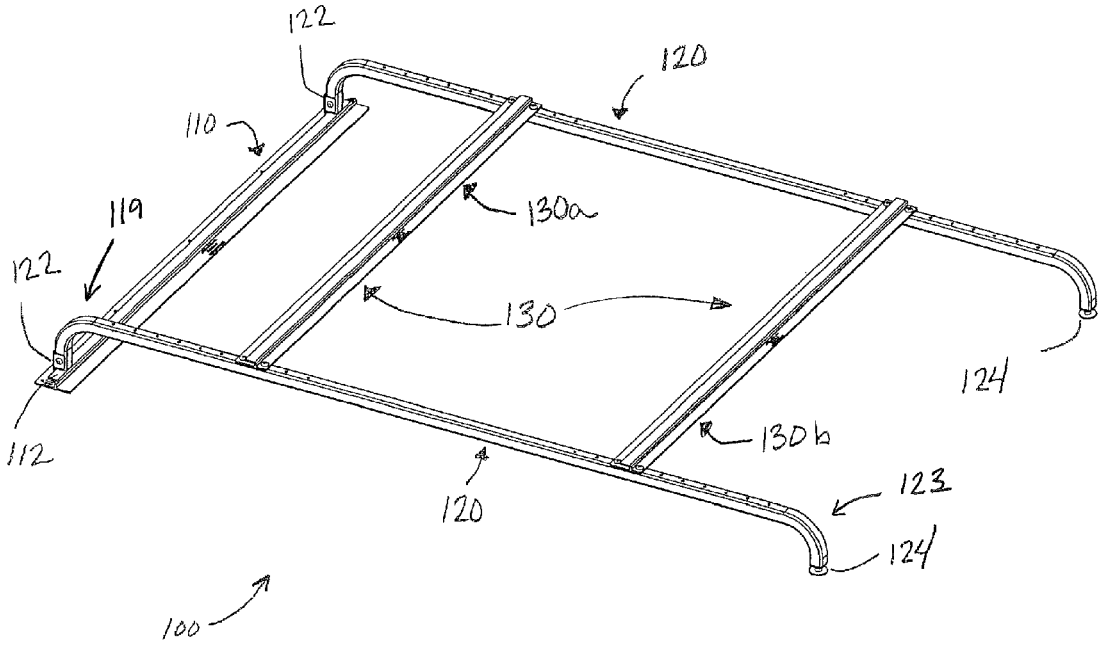
FIG. 1 illustrates a perspective view of an exemplary mounting system according to embodiments of the invention.

FIG. 1 illustrates a whiteboard mounting system 100 according to an exemplary embodiments of the present invention. In an exemplary embodiment, the mounting system 100 may have a top rail 110 that is attached to a wall or support surface (not shown) for the whiteboard (not shown). It is contemplated that at least one mounting arm 120 is removably attached to the top rail 110. However, in an exemplary embodiment, a plurality of mounting arms 120 may be removably attached to the top rail 110. The top rail 110 may include a support protrusion 112 that is configured to mate with an attachment portion 122 of the mounting arm 120. It is contemplated that at least one, and alternatively, a plurality of support rails 130 may connect to the mounting arms 120 and support the attached whiteboard. In an embodiment, the whiteboard (not shown) may be removably attached directly to the support rail 130 or may utilize a support feature 132 on the support rail 130.

The support rails 130 may be positioned along the mounting arms 120 at a plurality of heights to vertically adjust the whiteboard location. Additionally, the board may be supported at a plurality of positions on the support rails 130 which may permit horizontal adjustment of the board relative to the support rails 130. The mounting arm 120 may have at least a first end 119 and a second end 123. It is contemplated that the second end 123 of the mounting arm 120, which is located opposite to the attachment portion 122 and the first end 119 of the mounting arm 120, may include a leveling foot 124 that may adjust the distance from the wall which may ultimately assist in properly aligning the mounting system 100 relative to the wall.

In an exemplary embodiment, the mounting arms 120 may be contoured to fit over an existing wall feature. It is contemplated that the mounting arms 120 may have a convex and/or concave portion which may hold the whiteboard away from the supporting surface, such that a user may install the whiteboard over an existing blackboard. Moreover, the mounting arms 120 may be constructed to be longer than the height of the whiteboard, to permit greater placement options for the whiteboard on the mounting arms 120. Further the extended length of the mounting alms 120 may permit the mounting arms 120 to span and if necessary, exceed the height of the underlying black board (not shown). However, it should be understood that the mounting arms 120 may alternatively be configured to not have any convex or concave portion, and alternatively be flat against the support wall or within the frame of the whiteboard, to provide different aesthetic and special options.

Figure 1A:
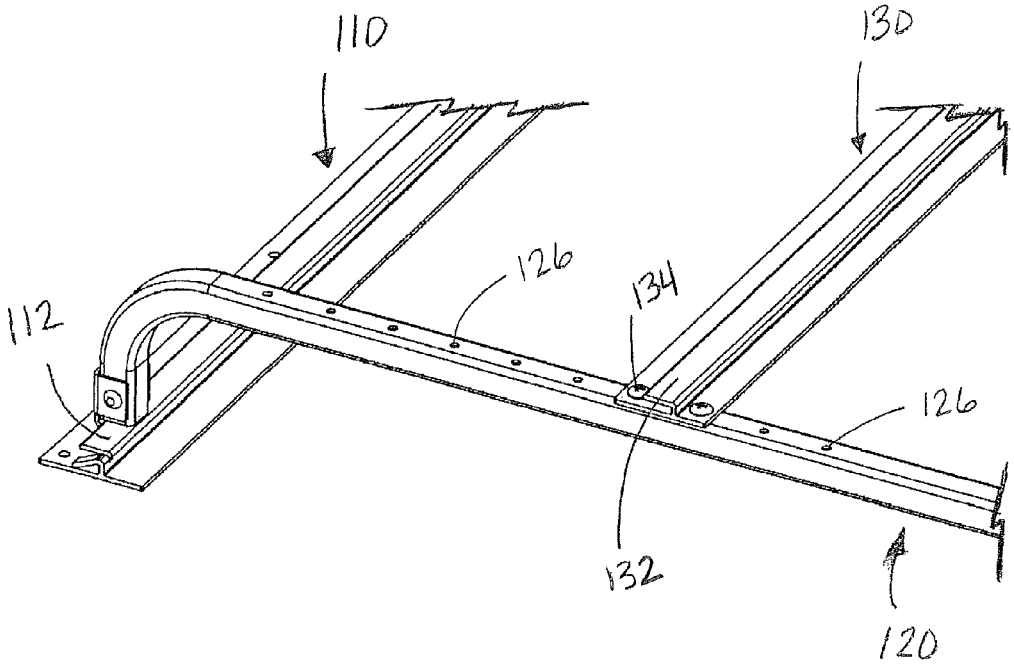
FIG. 1A illustrates a cut away portion of the mounting arm attached to a representative support rail, according to embodiments of the invention.
Figure 1B:
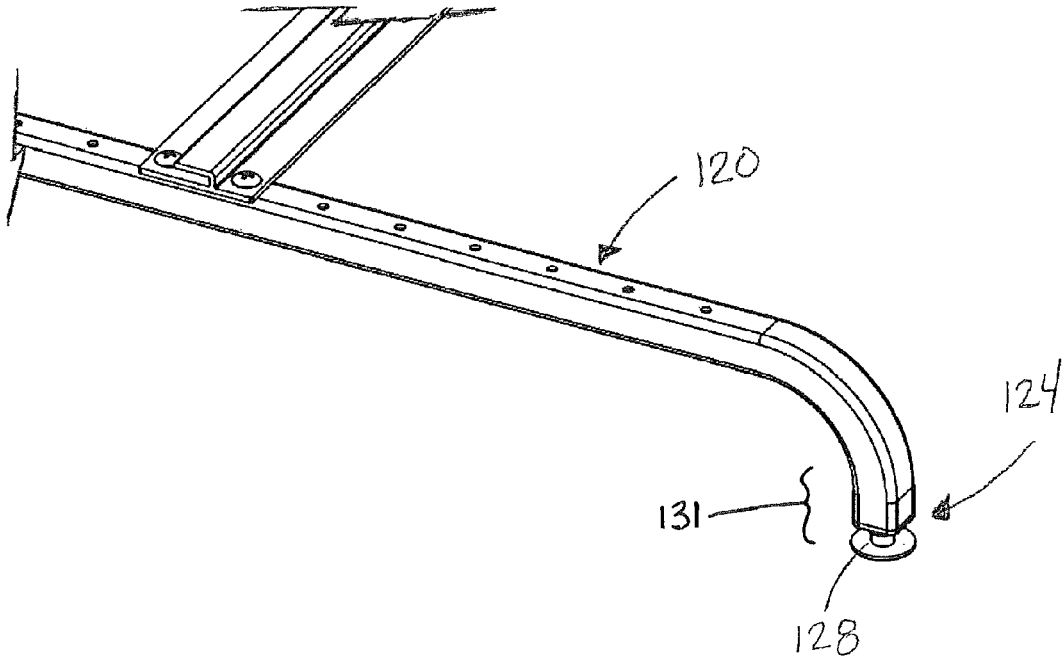
FIG. 1B illustrates a cut away portion of the mounting arm including a leveling foot, according to embodiments of the invention.

FIG. 1A illustrates a close up of the support rail 130 whereby the support rail 130 attaches to the mounting arm 120. In an exemplary embodiment, the support rail 130 may attach to the mounting arm 120 at a plurality of locations to permit the vertical adjustment of the whiteboard relative to the mounting arm 120. The support rail 130 may be attached to the mounting arm 120 by any of screws, rivets, pull-pins, friction sliders, and the like. For example, as seen in FIG. 1B, mounting arm 120 includes a plurality of screw holes 126 to allow for attachment of the support rail 130 to the mounting arm 120 via screws 134. In an exemplary embodiment, a plurality of holes are provided to permit a user to adjust the height of the whiteboard.

The support rail 130 may include a support feature 132 that may engage a corresponding feature on the whiteboard. For example, as shown in FIG. 1A, the support feature 132 is a cleat similar to the support protrusion 112 of the top rail 110. In an exemplary embodiment, the support feature 132 may be a cleat that resembles an upside down, half U-shaped hook that engages a corresponding feature on the back of the whiteboard (not shown). The whiteboard may include an upper edge including a lip projected outward then downward to create a mating hook for the support feature 132. In another exemplary embodiment, the support feature 132 of the support rail 130 and the corresponding feature of the whiteboard (not shown are configured to permit the whiteboard to easily slide in a horizontal direction. A stop may be provided along the support rail 130 or the corresponding feature of the whiteboard to prevent the board from sliding out of its rail or overbalancing the mounting system. It should be understood that a cleat is provided to removably attach the board to the support rail, however, a plurality of different attachment means may be utilized to attach same.

In another alternate embodiment, the mounting system may utilize hook and loop fasteners that may be used in place of the support feature on at least one of the support rails 130. For example, the mounting system 100 may include two support rails 130*a* and 130*b*, as seen in FIG. 1. The upper support rail 130*a* may be attached to the whiteboard with a support feature 132, as described above, while the lower support rail 130*b* may be attached to the whiteboard with a hook and loop fastener. In this case, the surface of the support rail 130*b* may have a hook or loop fastener, while the back of the whiteboard has the corresponding loop or hook fastener. The hook and loop fastener may be attached to the support rail or whiteboard by taping, gluing, adhering, bonding, stapling, or other device. Alternatively, for a more permanent connection, the support rail may be adhered to the whiteboard directly through taping, gluing, adhering, bonding, or other device.

FIG. 1B illustrates the lower corner of the mounting system 100 including the mounting arm 120 and leveling foot 124. In an exemplary embodiment, the mounting arms 120 includes a leveling foot 124 to adjust the angle of the mounting system 100. The leveling foot 124 may be an adjustable pad 128. The height of the leveling foot 124 may be adjusted utilizing devices, such as a sliding extension, a screw extension, or the like. The leveling foot 124 may be attached to the mounting arm 120 or another embodiment may be integrally formed with the mounting arm 120. In an exemplary embodiment, the leveling foot may be a cap portion that may be fit over the end portion 131 of the mounting arm 120. The adjustable pad 128 may be adjusted to properly align the whiteboard mounting system 100.

Figure 1C:
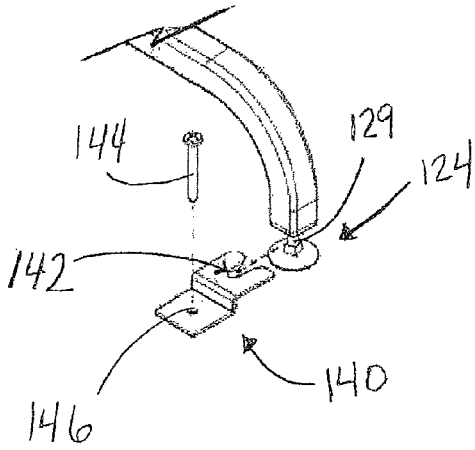
FIG. 1C illustrates an alternate embodiment of the leveling foot, including a finger cleat.

FIG. 1C illustrates cut away view of the lower corner of the mounting system 100, including the leveling foot 124 and finger cleat 140, according to an exemplary embodiment of the invention. In an exemplary embodiment, a finger cleat 140 may be mounted to the support surface (not shown) to additionally secure the leveling foot 124 and potentially add further support to the mounting system 100. The finger cleat 140 includes an indention 142 to fit around a neck 129 of the leveling foot 124 between the adjustable pad 128 and the mounting arm 120. The finger cleat 140 may be positioned so that the indention 142 in horizontal, and therefore, locks the mounting system 100 in place once installed. The finger cleat 140 may optionally be installed so the indention 142 faces upwards, and therefore, permits the mounting system 100 to be removed and replaced, repeatedly sliding into the indention from the top side while fitting the mounting system to the top rail. The finger cleat 140 may be secured to the support surface by a screw or nail 144 through hole 146. Other securing devices may be used, such as taping, anchoring, adhering, gluing, bonding, and the like.

In an exemplary embodiment, the system may utilize hook and loop fasteners that may be added to the mounting system 100 for additional stability. The adjustable pad 128 located on the leveling foot 124 of the mounting arm 120 may include a hook or loop fastener surface. A corresponding loop or hook fastener may be adhered to the mounting surface for attaching to its corresponding hook and fastener on the mounting arm 120. The hook and loop fasteners may be adhered, bonded, glued, or otherwise attached to the respective locations.

It is contemplated that the top rail 110 may be made of any sufficiently strong material to support the whiteboard. In an exemplary embodiment, the top hanging rail 110 may be constructed of aluminum that may be sufficiently rigid to support the attached board, but still light in weight to reduce the additional burden on the wall or supporting surface to which the system is attached. The mounting arms 120 may be constructed of steel to provide adequate support strength for the board. The support rails 130 may also be constructed of aluminum to reduce the weight of the mounting system 100. Other materials, for each component, may include metals or metal alloys, such as aluminum, aluminum alloy (e.g. 6063-T5), steel (18ga steel). Strong plastics or other materials may alternatively be used. It should be understood that a plurality of different materials may be utilized, and each component of the system 100 may be constructed of the same or different materials.

Figure 2:
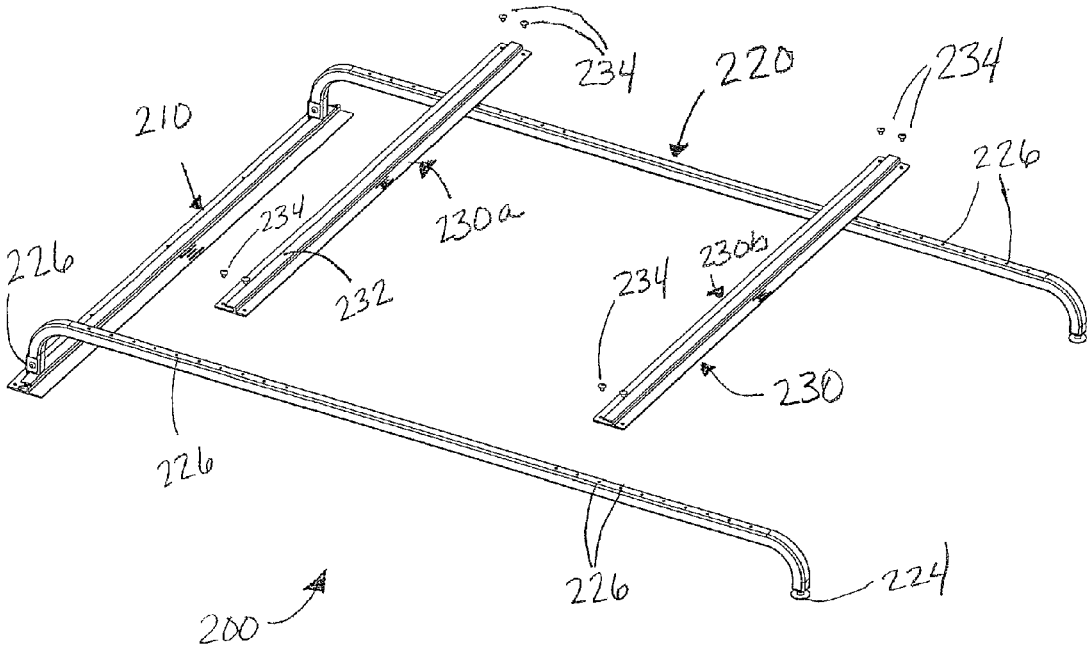
FIG. 2 illustrates an unassembled view of the mounting system according to embodiments of the invention.

FIG. 2 illustrates the mounting system 200 in the unassembled state, according to exemplary embodiments of the invention. In an exemplary embodiment, the mounting system 200 may be provided in a complete kit form which may include an aluminum top rail 210, two 18ga steel mounting arms 220 with steel hanger clips 226, leveler inserts 224, and two aluminum support rails 230. Additionally, the system 200 may include mounting equipment and instructions for assembling the system 200. The mounting system 200 may be designed to secure a smart board to a wall over an existing black board or whiteboard.

To install the top rail 210, the user would place the top rail above the existing chalk board (not shown), and secure the top rail 210 in the desired location. The top rail 210 may be attached to a wall (not shown) with wall anchors, nails, screws, or other securing devices, depending on the wall characteristics. Then, the support rails 230 may be removably attached to the mounting arms 220. The mounting arms 220 may include a plurality of holes 226 at set intervals, for example, one inch, to permit incremental adjustment in height. The support rails 230 may be attached to the mounting arms 220 by self-tapping screws.

Other coupling devices may provide screws, rivets, plugs, and the like. The support rails 230 may be attached with cleat 232 facing outward, away from the wall. Preferably, the first and second support rails 230*a* and 230*b* are utilized and preferably spaced the maximum distance apart to increase stability of the system 200. Once the mounting system 200 is fully assembled, the board may be hung from cleat 232 of the upper support rail 230*a*.

In an exemplary embodiment, the board may hang from the upper support rail 230*a* by corresponding features included on the top of the whiteboard. The lower support rail 230*b* may be attached to the board with double-faced tape. Once the position of the support rails 230 and mounting arms 220 are in the desired location. Double-faced tape is adhered between the lower support rail 230*b* and the whiteboard. The board is then pressed firmly to the lower support rail 230*b* to properly secure the connection. Alternatively, hook and loop fasteners may be used in place of the adhesive for a secure, but non-permanent coupling. Further, other fastening means may be employed to removably attach the board to the support rails 230*a* and *b*.

In an exemplary embodiment, hook and loop fasteners may be utilized used to increase the connection between the mounting system 200 and the supporting wall. Coin-shaped, hook fasteners may be adhered to the supporting wall or existing blackboard with double-faced tape, while the corresponding loop fastener may be adhered to the leveling foot 224. The hook and loop fasteners may be adhered by taping, gluing, bonding, or some other device.

In yet another exemplary embodiment, finger cleats (not shown in FIG. 2) may be utilized to secure the base of the mounting system 200 to the supporting wall. Once the mounting system 200 is hung, assembled, and positioned, the finger cleat may slide around the leveling foot 224 and be secured to the supporting wall. The finger cleat is secured to the wall using the appropriate wall anchor and screw 234, depending on the support wall characteristics. The finger cleat may also be adhered to the supporting wall, or existing chalkboard, such as by taping, bonding, gluing, and the like.

Another exemplary embodiment may include a permanently affixed wall mounted rail system 200 for interactive whiteboards. The system 200 is composed of a top hanging rail 230 and two support rails, two mounting arms 220 with leveling feet and mounting clip. The rail system semi-permanently attaches an interactive whiteboard to a wall. The top hanging rail 230 is permanently mounted to a wall with the appropriate fasteners. The mounting arms 220 are hung from the hanging rail 226 on the clip affixed to the top of the mounting arm 220. The two remaining support rails are attached to the mounting arms 220 with screws. The interactive whiteboard mounts to a cleat on the top support rail. Two hook and loop tabs 224 are attached with double-face tape to the leveling feet at the bottom of the mounting arms 220 and secured to the wall. Two hook and loop tabs 226 are attached to the bottom support rail 210 and secured to the back of the interactive whiteboard. In one embodiment, the mounting arm 220 includes a series of screw holes 234 to allow for height adjustment.

Although embodiments of this invention have been fully described with reference to the accompanying drawings, it is to be noted that various changes and modifications will become apparent to those skilled in the art. Such changes and modifications are to be understood as being included within the scope of embodiments of this invention as defined by the appended claims.

I claim:

1. A mounting system to allow attachment to a support surface, the system comprising:

a top rail configured to be coupled to the support surface;

at least one mounting arm attached to the top rail;

a top support rail removably attached directly to the at least one mounting arm and configured to support a device; and a bottom support rail removably attached directly to the at least one mounting arm and configured to attach to the device; wherein the at least one mounting arms includes a leveling foot attached to the support surface.

2. The mounting system of claim 1, wherein the top support rail has a cleat thereon to support the device.

3. The mounting system of claim 1, wherein the bottom rail attaches to the device through a hook and loop fastener means.

4. The mounting system of claim 1, wherein the leveling foot is attached to the support surface by a finger cleat.

5. The mounting system of claim 1, wherein the device is an interactive whiteboard.

6. A method of securing a mounting system to a support surface and mounting a display, thereon the method comprising the steps of:

securing a top rail a support surface;

coupling an upper support rail and lower support rail to at least one mounting arm, wherein the upper support rail includes a cleat facing away from the at least one mounting arms;

hanging at least one mounting arm from the top rail; and mounting the display by hanging the display from the cleat on the upper support rail and connecting the display to the lower support rail with a hook and loop fastener means.

* * * * *